US006230847B1

(12) United States Patent
Skolnick

(10) Patent No.: US 6,230,847 B1
(45) Date of Patent: May 15, 2001

(54) FLASHING "DOOR OPEN" BUTTON FOR AN ELEVATOR CAR

(75) Inventor: Steve Skolnick, Simsbury, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/464,129

(22) Filed: Dec. 16, 1999

(51) Int. Cl.[7] ..... B66B 3/00
(52) U.S. Cl. ..... 187/395; 187/414
(58) Field of Search ..... 187/395, 414, 187/390, 391; 49/13, 120

(56) References Cited

U.S. PATENT DOCUMENTS 4,716,992 * 1/1988 Kunii ..... 187/395
5,454,448 * 10/1995 Bittar et al. ..... 187/395
5,969,306 * 10/1999 Velauthapillai et al. ..... 187/395

FOREIGN PATENT DOCUMENTS 2-188383 * 7/1990 (JP) .
3-95093 * 4/1991 (JP) .
4-191250 * 7/1992 (JP) .
6-271258 * 9/1994 (JP) .
7-25556 * 1/1995 (JP) .
8-259128 * 10/1996 (JP) .
10-120325 * 5/1998 (JP) .

* cited by examiner

*Primary Examiner*—Eileen D. Lillis
*Assistant Examiner*—Thuy V. Tran

(57) ABSTRACT

A flashing "door open" button positioned on an elevator car control panel. The flashing button is connected to a door opener and flashes at predetermined times during the operation of an elevator.

7 Claims, 1 Drawing Sheet

FLASHING "DOOR OPEN" BUTTON FOR AN ELEVATOR CAR

TECHNICAL FIELD

The present invention relates to "door open" buttons in elevators, and, more particularly, to a flashing "door open" button in an elevator that can be more easily located than the conventional non-flashing "door open" buttons.

BACKGROUND OF THE INVENTION

Elevator cars in most modern day elevator systems include operating panels therewithin providing command directions for the elevator car. The operating panels are designed to take directions from an occupant of the elevator to execute a desired task.

Elevator car operating panels typically have numerous buttons arranged in a grid pattern with rows and columns of buttons side-by-side and close together. These buttons designate floor numbers. Two additional buttons, a "door open" and a "door close" button, are usually situated in close proximity to each other and within the grid of floor number buttons. These "door open" and "door close" buttons are used to either open or close the elevator doors when the elevator is discharging or loading passengers at a floor landing and when automatic operation of the doors is adjudged insufficient by the occupant.

People often try to enter the elevator car from the landing as the doors of the elevator car are closing. In the event at least one other passenger is already inside the elevator car, such passenger may attempt to accommodate the people trying to enter by pressing the "door open" button to reverse the closing of the doors.

Sometimes, however, a hurried attempt to press the "door open" button results in the inadvertent pressing of the "door close" button or some other button. The elevator door then closes and the elevator begins its ascent or descent before the passenger pushing the button realizes that he pushed the wrong button instead of the "door open" button. The person who tried to enter the elevator is then left standing on the landing and must wait for the next elevator.

One prior art system uses complicated circuitry to open an elevator door while the elevator is discharging or loading passengers even if the "door close" button is pressed. This type of system adds electronic components such as limiting switches and microcomputers to other conventional elevator system equipment and only adds to the cost of the equipment and maintenance of the elevator system.

Furthermore, in the latter stated system, when the "door close" button is pressed by an elevator passenger who really wants the elevator doors to close because he is in a hurry, the elevator doors will open. In such an instance, the elevator passenger will most likely repeatedly press the "door close" button only to have the doors begin to close then reopen. This repeated pressing of the "door close" button and continuous opening of the doors only confuses and frustrates the elevator passenger.

Other prior art elevator systems eliminate the "door close" button altogether. The absence of this button only serves to infuriate the elevator passenger who is in a hurry to have the doors close so he can be under way. The elevator passenger in an elevator that has no "door close" button is left with the less satisfying option of repeatedly pressing his "floor designation" button.

SUMMARY OF THE INVENTION

The present invention overcomes the disadvantages of the prior art by providing a "door open" button for an elevator car that is illuminated and flashes during a "door-closing" mode of the elevator car. The structure of the button is preferably outwardly conventional in order to avoid a redesigning of the operating panel and maintains aesthetics of existing panels. This also provides for the possibility of retrofit installations of the buttons of the invention.

The button comprises a housing having a translucent cover. An illumination source is positioned inside the housing and under the translucent cover. The illumination source is connected to a power source and operational circuitry. The structure of the power source is well known in the art.

The illumination source for the button alternates between an "on" and "off" position, and the rate of this alternation may be variable. The translucent cover of the housing may have a conventional "door open" symbol printed on it, or it may be colored.

BRIEF DESCRIPTION OF THE DRAWINGS

The present invention will now be described with reference to the accompanying drawings, which are meant to be exemplary, not limiting, and wherein like elements are numbered alike in several figures, in which.

DETAILED DESCRIPTION OF THE INVENTION

Figure 1:
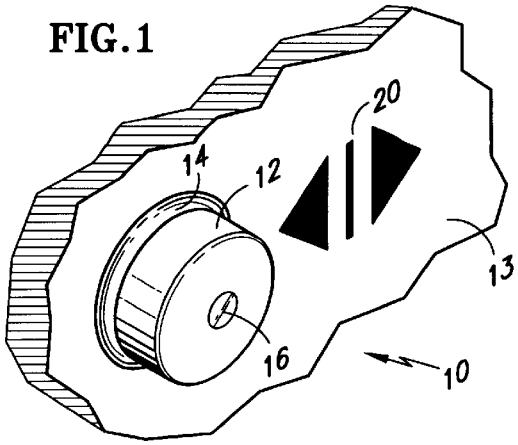
FIG. 1 is a perspective view of an elevator button, of the present invention, having a light disposed within a button housing and being situated proximate a "door open" symbol.

Referring to FIG. 1, an exemplary embodiment of a flashing "door open" button is shown generally at 10. Button 10 is comprised of a housing 12 held onto a face plate 13 by a retaining member 14. Housing 12 may be biased away from face plate 13 by a spring (not shown) and capable of returning to its original biased position upon being depressed in the direction of face plate 13. Face plate 13 is typically an elevator control panel. A light 16 is dimensioned and positioned on or in housing 12. The electronic circuitry providing power to light 16 is configured to cause the light to flash at predetermined times that correspond to the closing of an elevator door (not shown). Positioned proximate to housing 12 is a "door open" symbol 20. Symbol 20 is the standard "door open" symbol that is well known in the art and comprises two triangles separated by a line and pointing away from each other.

Figure 2:
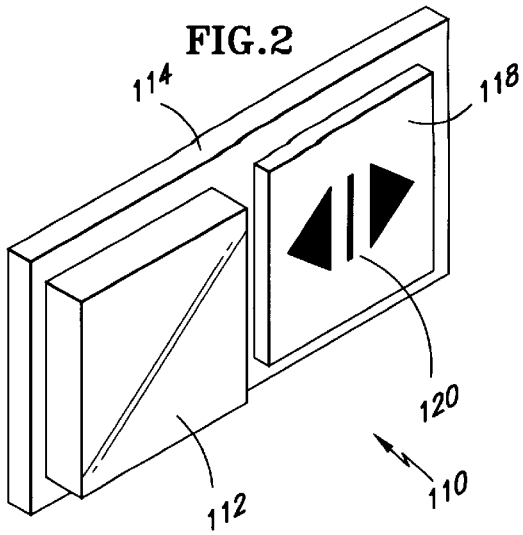
FIG. 2 is a perspective view of an alternate embodiment of an elevator button, of the present invention, wherein the entire button housing is a light, and wherein the button is situated proximate a "door open" symbol.

An alternate embodiment of a flashing "door open" button is shown generally at 110 in FIG. 2. Button 110 comprises a housing 112 fabricated from a material that allows it to be illuminated by a light source (not shown) inside a retaining member 114. The electronic circuitry is configured to cause the light to flash at predetermined times which correspond to the closing of an elevator door (not shown). The electronic circuitry providing power to the light and configurations capable of causing a light to flash are well known in the art. Housing 112 is biased away from retaining member 114 by a spring (not shown) and returns to this position after being pressed and released. Also positioned on retaining member 114 and proximate to housing 112 is a plate 118. Plate 118 has depicted on it a "door open" symbol 120. Symbol 120 is the standard "door open" symbol that is well known in the art and comprises two triangles separated by a line pointing away from each other.

Figure 3:
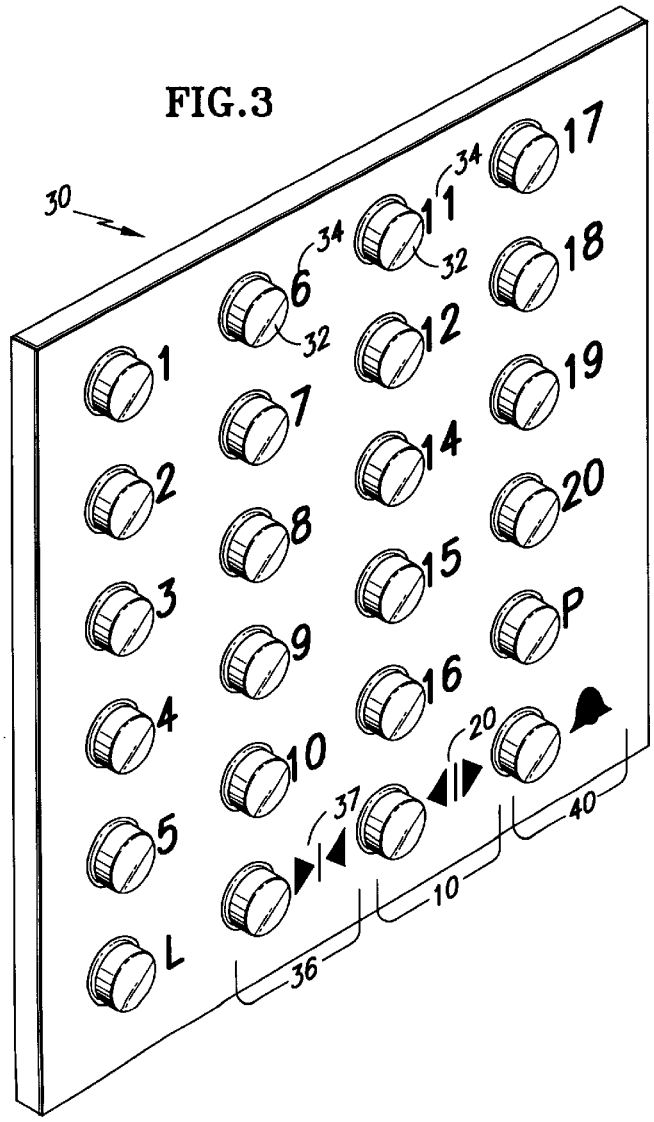
FIG. 3 is a schematic view of a control panel showing rows and columns of floor designation buttons and numbers, a "door open" button with its symbol, and a "door close" button with its symbol.

Referring now to FIG. 3, a control panel of an elevator is generally shown at 30. Floor designation buttons 32 are typically arranged in rows and columns with floor designation numbers 34 positioned alongside each floor designation button 32. Positioned also on elevator car control panel 30 are various other buttons including a "door close" button shown generally at 36 and a safety call button shown generally at 40. Flashing "door open" button 10 is also depicted.

A large number of floor designation buttons 32 and corresponding floor designation numbers 34 are situated on elevator car control panel 30. In larger buildings, this number may increase. As the number of floor designation buttons 32 and the corresponding number of floor designation numbers 34 increases, it becomes difficult for a person to quickly discern and press the correct floor designation button 32 even though floor designation buttons are not ambiguous and are usually easy to see. Finding the "door open" button amidst the large number of buttons and symbols on elevator car control panel 30 is very difficult. As stated, this can be annoying to elevator patrons in the event that the closing doors of the elevator need to be reopened quickly to allow a person trying to board the elevator ingress to the car. Moreover, "door open" symbol 20 is easily confused with a "door close" symbol 37 on "door close" button 36 making it even more difficult to choose the correct button during the short time it takes elevator doors to close. The problem is removed with the embodiments of the invention.

Figure 4:
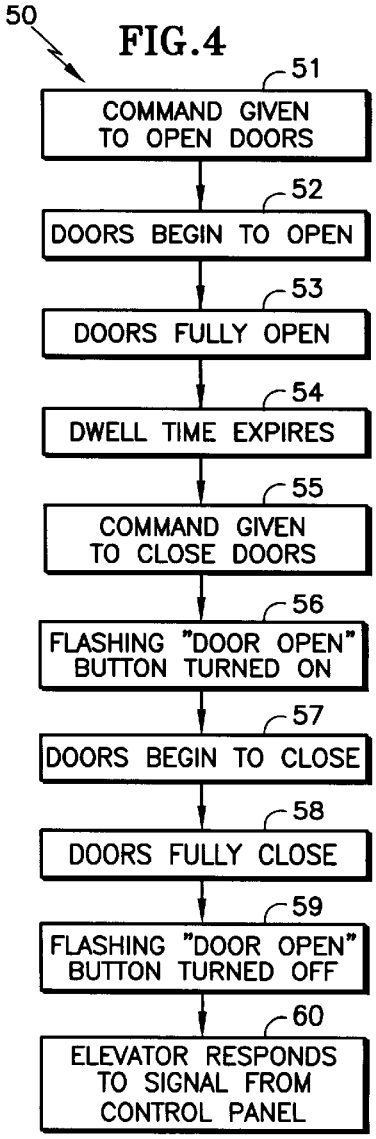
FIG. 4 is a flowchart showing the steps involved in turning the flashing "door open" button, of the present invention, on and off during the operation of an elevator.

In FIG. 4, flowchart 50 shows the steps involved in one preferred embodiment for turning on flashing "door open" button 10. A software program from a control center typically executes the control steps of flowchart 50 while the mechanical steps are executed by mechanical components of the elevator system.

When an elevator arrives at a floor landing, the command to open the elevator doors is given by the control center in a step 51. In a step 52, the mechanical components (not shown) begin to open the doors until they are fully opened in a step 53. Control is then passed back to the control center, and a step 54 counts through a predetermined time, or "dwell" time, during which the doors remain open. In a step 55 this predetermined time expires and a command is given to close the doors. A step 56 then turns on the flashing "door open" button 10, and in a step 57 a signal passes from the control center to close the doors, and the mechanical components are actuated and begin to close the doors. In a step 58, the control center receives a signal that the doors are fully closed. Once the control center receives this signal, it turns off the flashing "door open" button 10 in a step 59. The control center then gives the signal to the mechanical components to respond to the elevator control panel 30.

In the preferred embodiment, "door open" button 10 constantly alternates between an illuminated and a non-illuminated state when steps 56 through 58 of FIG. 4 are executed. The frequency of alternation between the illuminated and non-illuminated states, or rate of "flashing", may be variable and set by an elevator maintenance person. The flashing of "door open" button 10 makes "door open" button 10 more easily discernable to passengers attempting to quickly locate "door open" button 10 to open the elevator doors for late-arriving elevator passengers. Alternately, "door open" button 10 can be constantly illuminated during the steps 56 through 58 in which the doors are closing. Furthermore, if floor designation buttons 32 are illuminated when pressed, "door open" button 10 can be illuminated of a different color than floor designation buttons 32.

While this invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A device for getting attention during the closing of doors of an elevator car in an elevator system comprising:

a button operably connected to a device for opening and closing said doors of said elevator said button controlling said device to open said doors when said button is pressed; and a light source for illuminating said button and operably connected to said device for opening and closing said doors and and whereby said light source illuminates said button upon receipt of a door close command and ceases illuminating said button upon closure of said doors.

2. The attention-getting device of claim 1 wherein said button comprises a housing having said light source light conductively connected thereto.

3. The attention-getting device of claim 2 wherein said housing comprises a translucent cover that is illuminated by said light source disposed under said translucent cover.

4. The attention-getting device of claim 3 wherein said translucent cover is colored.

5. The attention-getting device of claim 1 wherein said light source remains illuminated during an operation of said doors of said elevator.

6. The attention getting device of claim 1 wherein said light source flashes.

7. The attention getting device of claim 6 wherein a rate of said flashing is variable.

* * * * *